US006943743B2

(12) United States Patent
Durham et al.

(10) Patent No.: US 6,943,743 B2
(45) Date of Patent: Sep. 13, 2005

(54) REDIRECTING FEEDTHROUGH LENS ANTENNA SYSTEM AND RELATED METHODS

(75) Inventors: Timothy E. Durham, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/828,749

(22) Filed: Apr. 21, 2004

(65) Prior Publication Data

US 2005/0030236 A1 Feb. 10, 2005

Related U.S. Application Data

(63) Continuation-in-part of application No. 10/634,036, filed on Aug. 4, 2003, now Pat. No. 6,856,297.

(51) Int. Cl.[7] ..... H01Q 1/38; H01Q 15/02
(52) U.S. Cl. ..... 343/753; 343/795; 343/797
(58) Field of Search ..... 343/753–756, 343/795, 797

(56) References Cited

U.S. PATENT DOCUMENTS

| | | | | |
|---|---|---|---|---|
| 3,995,277 | A | 11/1976 | Olyphant, Jr. | 343/846 |
| 5,053,785 | A * | 10/1991 | Tilston et al. | 343/756 |
| 5,132,699 | A | 7/1992 | Rupp et al. | 343/880 |
| 5,801,660 | A | 9/1998 | Ohtsuka et al. | 343/700 MS |
| 5,859,619 | A | 1/1999 | Wu et al. | 343/781 CA |
| 6,198,460 | B1 | 3/2001 | Brankovic | 343/879 |
| 6,293,027 | B1 | 9/2001 | Elliott et al. | 33/546 |
| 6,307,510 | B1 | 10/2001 | Taylor et al. | 343/700 MS |
| 6,366,256 | B1 | 4/2002 | Ramanujam et al. | 343/781 CA |
| 6,417,813 | B1 * | 7/2002 | Durham | 343/753 |
| 6,448,937 | B1 | 9/2002 | Aiken et al. | 343/817 |
| 6,456,252 | B1 | 9/2002 | Goyette | 343/779 |
| 6,483,464 | B2 | 11/2002 | Rawnick et al. | 343/700 MS |
| 6,512,487 | B1 * | 1/2003 | Taylor et al. | 343/795 |
| 6,552,687 | B1 | 4/2003 | Rawnick et al. | 343/700 MS |
| 6,583,766 | B1 | 6/2003 | Rawnick et al. | 343/841 |
| 6,876,336 | B2 * | 4/2005 | Croswell et al. | 343/795 |
| 2002/0050951 | A1 * | 5/2002 | Durham | 343/700 MS |
| 2005/0001778 | A1 * | 1/2005 | Le et al. | 343/810 |

* cited by examiner

*Primary Examiner*—Tan Ho
*Assistant Examiner*—Hung Tran Vy
(74) *Attorney, Agent, or Firm*—Allen, Dyer, Doppelt, Milbrath & Gilchrist, P.A.

(57) ABSTRACT

A redirecting feedthrough lens antenna system may include first and second phased array antennas coupled together in back-to-back relation. More particularly, the first and second phased array antennas may include respective first and second arrays of dipole antenna elements thereon, wherein each dipole antenna element may include a medial feed portion and a pair of legs extending outwardly therefrom. The system may also include a respective phase shifter connected between each pair of back-to-back dipole antenna elements of the first and second dipole antenna arrays. Furthermore, a controller may be included for cooperating with the phase shifters to cause a signal received by the first phased array antenna at a first angle to be transmitted from the second phased array antenna at a redirected second angle different from the first angle.

19 Claims, 8 Drawing Sheets

REDIRECTING FEEDTHROUGH LENS ANTENNA SYSTEM AND RELATED METHODS

CROSS-REFERENCE TO RELATED APPLICATIONS

This application is a continuation-in-part of U.S. application Ser. No. 10/634,036, now U.S. Pat. No. 6,856,297 filed Aug. 4, 2003, which is hereby incorporated herein in its entirety by reference.

FIELD OF THE INVENTION

The present invention relates to the field of communications systems, and more particularly, to phased array antennas.

BACKGROUND OF THE INVENTION

Existing microwave antennas include a wide variety of configurations for various applications, such as satellite reception, remote broadcasting, or military communication. The desirable characteristics of low cost, light weight, low profile and mass producibility are provided in general by printed circuit antennas. The simplest forms of printed circuit antennas are microstrip antennas wherein flat conductive elements, such as monopole or dipole antenna elements, are spaced from a single essentially continuous ground plane by a dielectric sheet of uniform thickness. An example of a microstrip antenna is disclosed in U.S. Pat. No. 3,995,277 to Olyphant.

The antennas are designed in an array and may be used for communication systems such as identification of friend/foe (IFF) systems, personal communication service (PCS) systems, satellite communication systems, and aerospace systems, which require such characteristics as low cost, light weight, low profile, and a low sidelobe. The bandwidth and directivity capabilities of such antennas, however, can be limiting for certain applications.

The use of electromagnetically coupled dipole antenna elements can increase bandwidth. Also, the use of an array of dipole antenna elements can improve directivity by providing a predetermined maximum scan angle.

However, utilizing an array of dipole antenna elements presents a dilemma. The maximum grating lobe free scan angle can be increased if the dipole antenna elements are spaced closer together, but a closer spacing can increase undesirable coupling between the elements, thereby degrading performance. This undesirable coupling changes rapidly as the frequency varies, making it difficult to maintain a wide bandwidth.

One approach for compensating the undesirable coupling between dipole antenna elements is disclosed in U.S. Pat. No. 6,417,813 to Durham, which is hereby incorporated herein in its entirety by reference, and which is assigned to the current Assignee of the present invention. This patent discloses a wideband phased array antenna comprising an array of dipole antenna elements, with each dipole antenna element comprising a medial feed portion and a pair of legs extending outwardly therefrom.

In particular, adjacent legs of adjacent dipole antenna elements include respective spaced apart end portions having predetermined shapes and relative positioning to provide increased capacitive coupling between the adjacent dipole antenna elements. The increased capacitive coupling counters the inherent inductance of the closely spaced dipole antenna elements, in such a manner as the frequency varies so that a wide bandwidth may be maintained.

The above-noted patent further teaches that the benefits of such phased array antennas may be extended to a feedthrough lens antenna configuration, in which two such antennas are coupled together in back-to-back relationship. Such an antenna advantageously allows signals to pass through objects which would otherwise obstruct or degrade the signals (e.g., walls) without being substantially affected. Yet, despite the advantages provided by such arrangements, further feedthrough lens antenna control features may be desirable in certain applications.

SUMMARY OF THE INVENTION

In view of the foregoing background, it is therefore an object of the present invention to provide a feedthrough lens antenna system with enhanced control features and related methods.

This and other objects, features, and advantages in accordance with the present invention are provided by a redirecting feedthrough lens antenna system which may include first and second phased array antennas coupled together in back-to-back relation. More particularly, the first and second phased array antennas may include respective first and second arrays of dipole antenna elements thereon, where each dipole antenna element may include a medial feed portion and a pair of legs extending outwardly therefrom. The system may also include a respective phase shifter connected between each pair of back-to-back dipole antenna elements of the first and second dipole antenna arrays. Furthermore, a controller may be included for cooperating with the phase shifters to cause a signal received by the first phased array antenna at a first angle to be transmitted from the second phased array antenna at a redirected second angle different from the first angle.

In addition, the feedthrough lens antenna system may further include a respective gain element also connected between each pair of back-to-back dipole antenna elements of the first and second dipole antenna arrays. The controller may also control a gain of the gain elements. Moreover, the phase shifters and gain elements connected between each pair of back-to-back dipole antenna elements of the first and second dipole antenna arrays may be connected in series.

By way of example, adjacent legs of adjacent dipole antenna elements may include respective spaced apart end portions. More particularly, the spaced apart end portions may have predetermined shapes and relative positioning to provide increased capacitive coupling between the adjacent dipole antenna elements. The system may also include a respective impedance element electrically connected between the spaced apart end portions of adjacent legs of adjacent dipole antenna elements. The impedance elements may be capacitors or inductors, for example. Also, the system may include a ground plane adjacent the first and second dipole element arrays.

A method aspect of the invention is for using a redirecting feedthrough lens antenna system, such as the one described briefly above. The method may include controlling the phase shifters to cause a signal received by the first phased array antenna at a first angle to be transmitted from the second phased array antenna at a redirected second angle different from the first angle.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternate embodiments.

Figure 1:
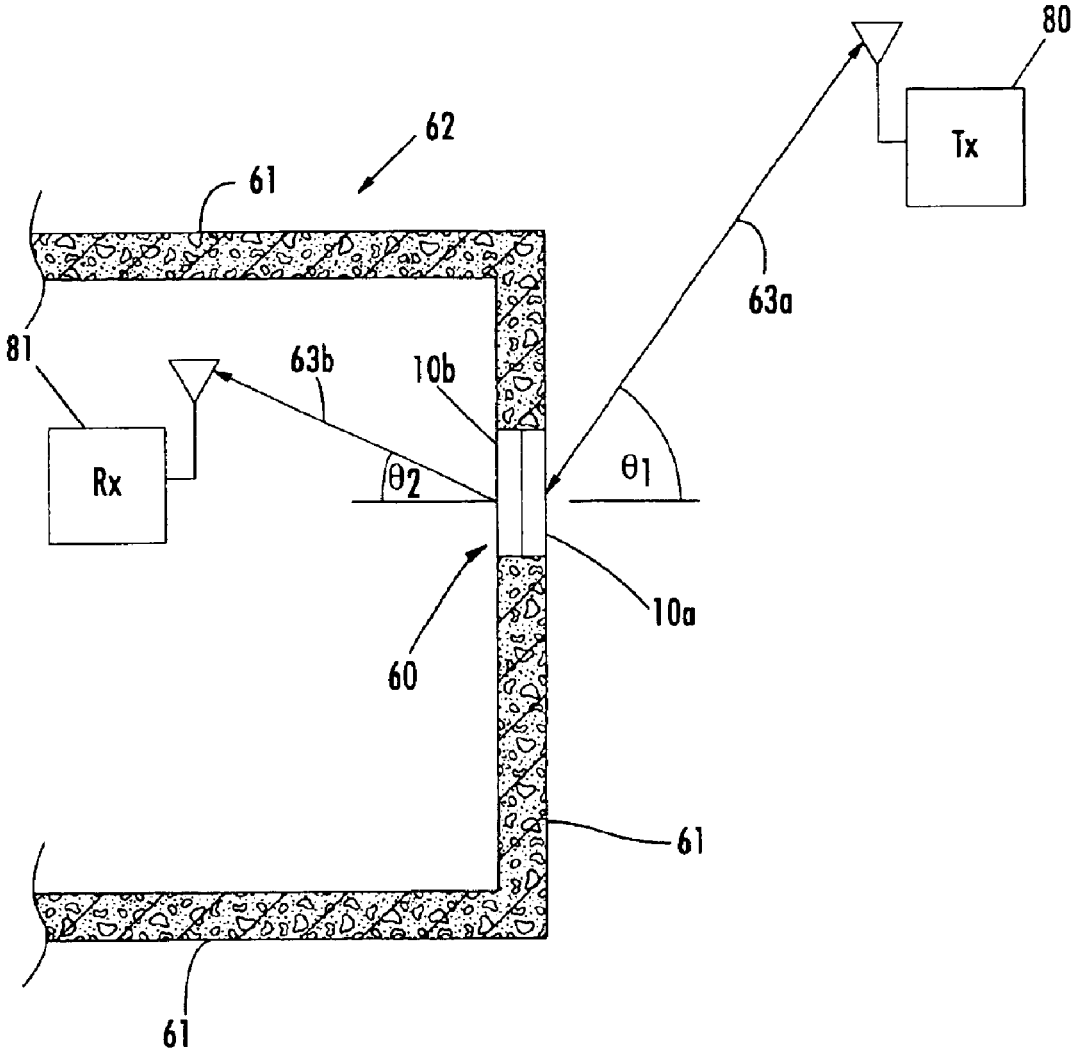
FIG. 1 is top plan view of a building partly in sectional illustrating a redirecting feedthrough lens antenna system according to the present invention positioned in a wall of the building.

Referring initially to FIG. 1, a redirecting feedthrough lens antenna system 60 according to the present invention is first described. As noted above, feedthrough lens antennas may be used in a variety of applications where it is desired to replicate an EM environment within a structure, such as a building 62, over a particular bandwidth. For example, the redirecting feedthrough lens antenna system 60 may be positioned on a wall 61 of the building 62. Of course, it will be appreciated that the redirecting feedthrough lens antenna system 60 may be used on other structures as well, such as the wall of a ship, for example, or in other applications where it is desirous to pass a signal through a structure that would otherwise obstruct or degrade the signal.

As illustratively shown in FIG. 1, the redirecting feedthrough lens antenna system 60 allows EM signals 63 from a transmitter 80 (e.g., a cellular telephone base station) to be replicated and redirected within the interior of the building 62 and received by a receiver 81 (e.g., a cellular telephone), as will be discussed further below.

The feedthrough lens antenna system 60 illustratively includes first and second phased array antennas 10*a*, 10*b*, which are preferably substantially identical. Generally speaking, the redirecting feedthrough lens antenna system 60 causes the EM signals 63 received by the first phased array antenna 10*a* at a first angle $\theta_1$ to be transmitted from the second phased array antenna 10*b* at a second angle $\theta_2$ different from the first angle. For clarity of explanation, prior to describing the redirection features of the redirecting feedthrough lens antenna system 60, a single phased array antenna 10 will first be described with reference to FIGS. 2–5.

Figure 2:
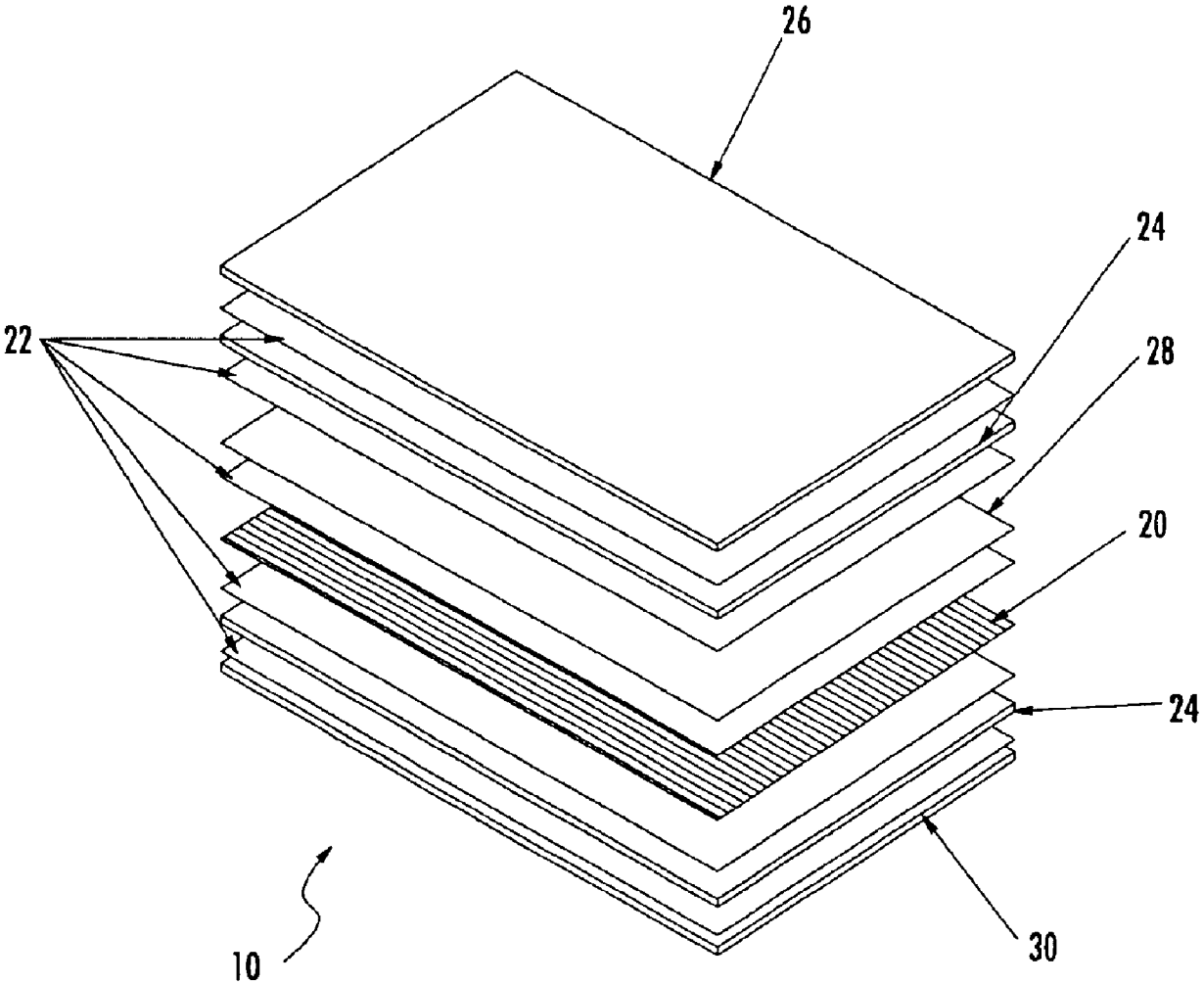
FIG. 2 is an exploded view of a phased array antenna of the redirecting feedthrough lens antenna system of FIG. 1.

The wideband phased array antenna 10 is preferably formed of a plurality of flexible layers, as shown in FIG. 2. These layers include a dipole layer 20, or current sheet, which is sandwiched between a ground plane 30 and a cap layer 28. Additionally, dielectric layers of foam 24 and an outer dielectric layer of foam 26 are provided. Respective adhesive layers 22 secure the dipole layer 20, ground plane 30, cap layer 28, and dielectric layers of foam 24, 26 together to form the flexible and conformal antenna 10. Of course, other ways of securing the layers may also be used, as will be appreciated by the skilled artisan.

The dielectric layers 24, 26 may have tapered dielectric constants to improve the scan angle. For example, the dielectric layer 24 between the ground plane 30 and the dipole layer 20 may have a dielectric constant of 3.0, the dielectric layer 24 on the opposite side of the dipole layer 20 may have a dielectric constant of 1.7, and the outer dielectric layer 26 may have a dielectric constant of 1.2. It should be noted that other approaches may also be used to make the antenna 10 operate without the upper dielectric layers 24, 26. However, generally speaking it is typically desirable to include the dielectric layers 24, 26 above the layer 20.

Figure 3:
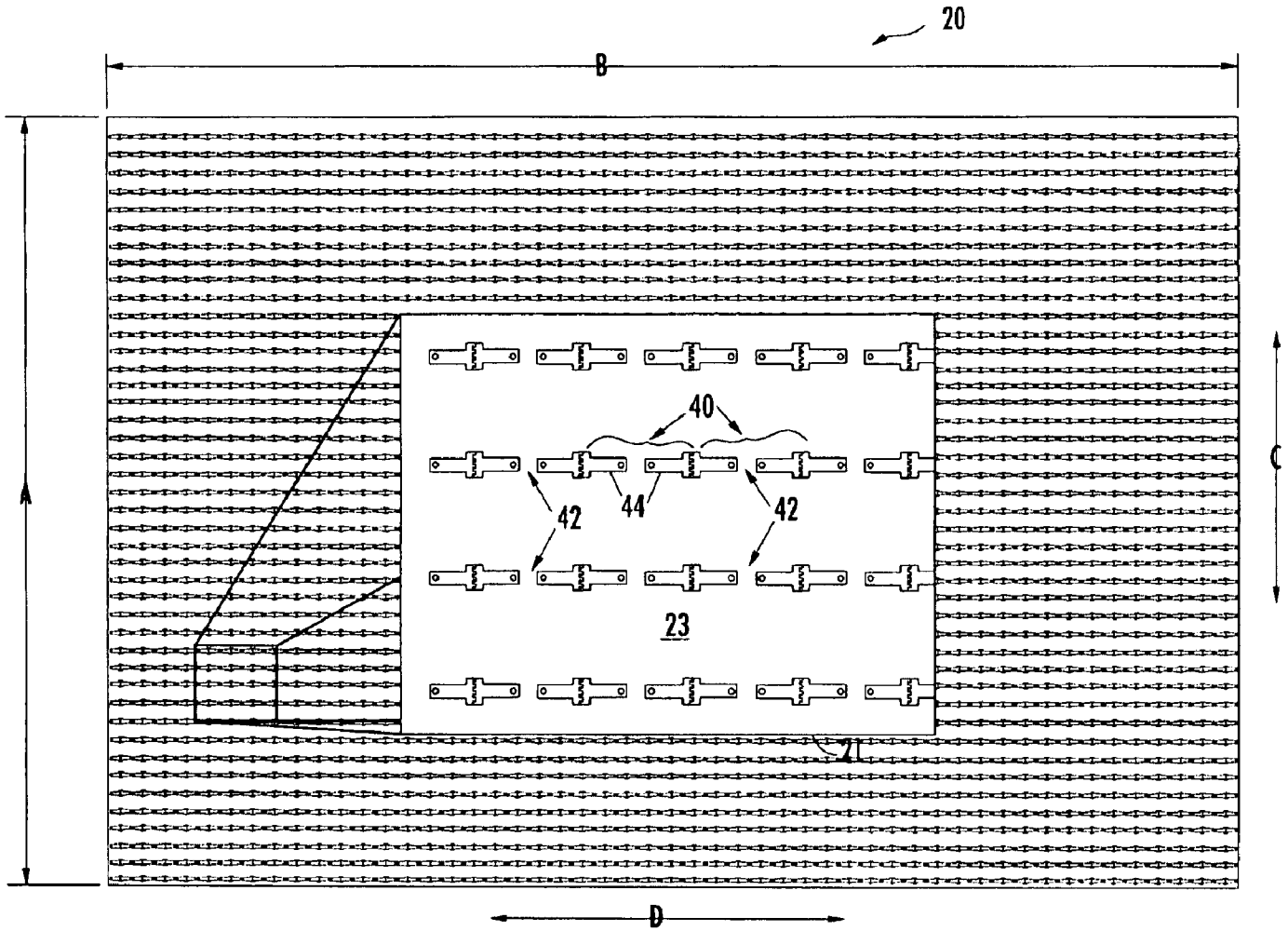
FIG. 3 is a schematic diagram of the printed conductive layer of the phased array antenna of FIG. 2.
Figure 4A:
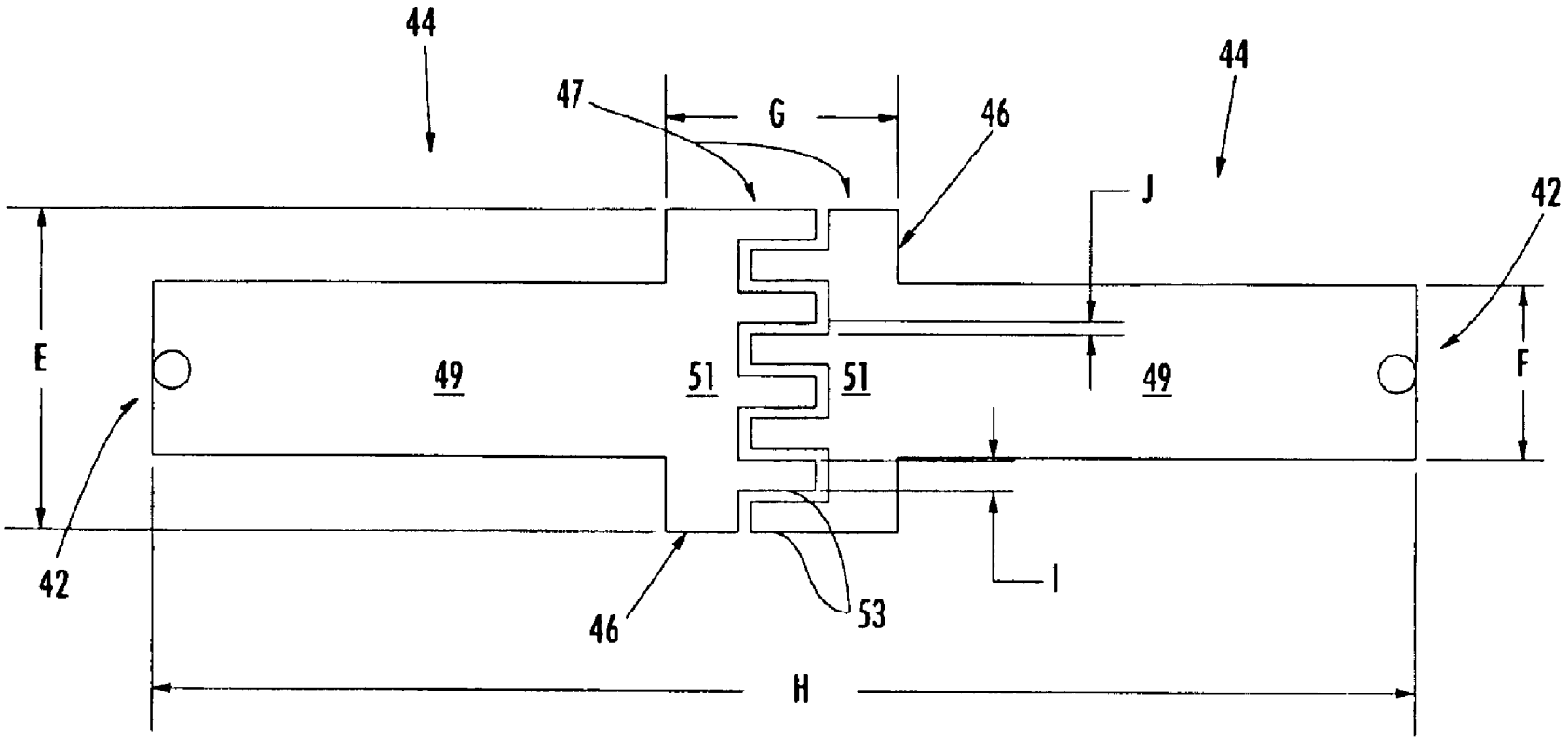
FIGS. 4A through 4D are enlarged schematic views of various spaced apart end portion configurations of adjacent legs of adjacent dipole antenna elements of the wideband phased array antenna of FIG. 2.
Figure 4B:
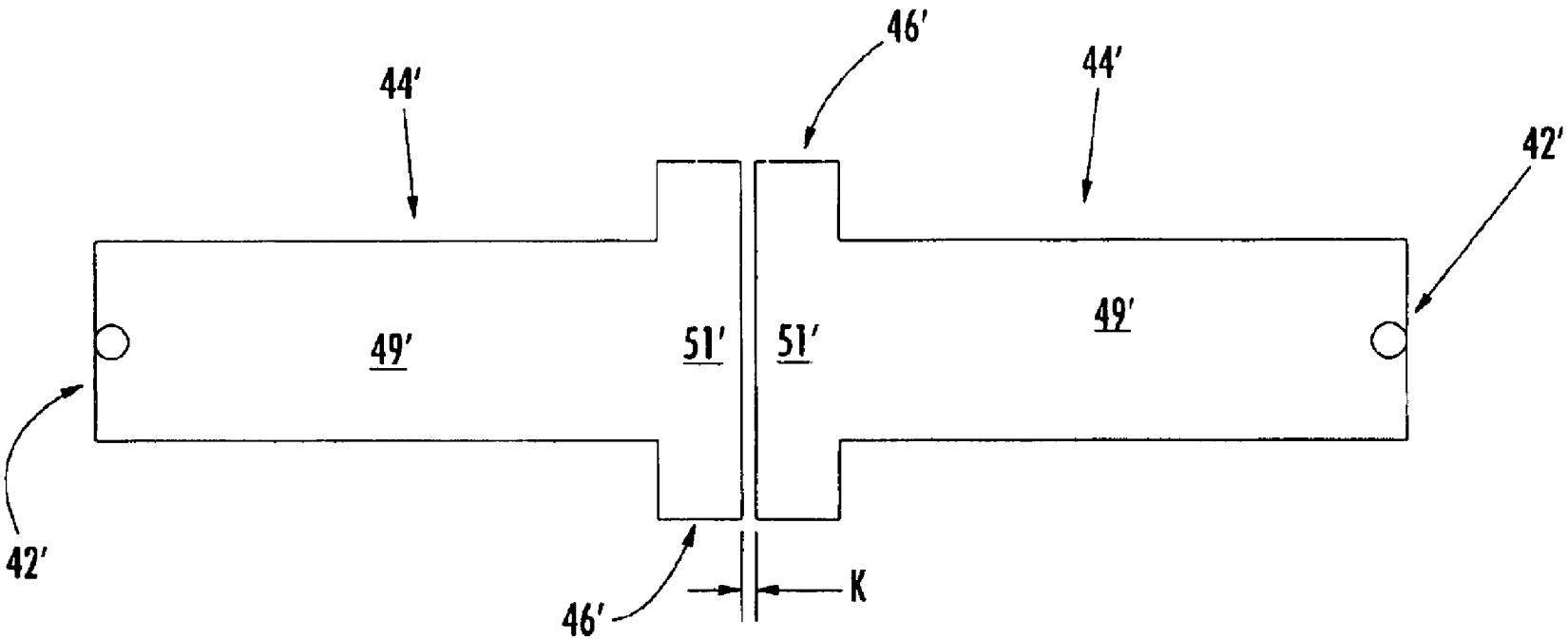

Referring now to FIGS. 3, 4A and 4B, a first embodiment of the dipole layer 20 will now be described. The dipole layer 20 is a printed conductive layer having an array of dipole antenna elements 40 on a flexible substrate 23. Each dipole antenna element 40 comprises a medial feed portion 42 and a pair of legs 44 extending outwardly therefrom. Respective feed lines are connected to each feed portion 42 from the opposite side of the substrate, as will be described in greater detail below. Adjacent legs 44 of adjacent dipole antenna elements 40 have respective spaced apart end portions 46 to provide increased capacitive coupling between the adjacent dipole antenna elements. The adjacent dipole antenna elements 40 have predetermined shapes and relative positioning to provide the increased capacitive coupling. For example, the capacitance between adjacent dipole antenna elements 40 may be between about 0.016 and 0.636 picofarads (pF), and preferably between 0.159 and 0.239 pF.

Preferably, as shown in FIG. 4A, the spaced apart end portions 46 in adjacent legs 44 have overlapping or interdigitated portions 47, and each leg 44 comprises an elongated body portion 49, an enlarged width end portion 51 connected to an end of the elongated body portion. Each leg 44 further comprises a plurality of fingers 53 (e.g., four) extending outwardly from the enlarged width end portion.

Alternatively, as shown in FIG. 4B, adjacent legs 44' of adjacent dipole antenna elements 40' may have respective spaced apart end portions 46' to provide increased capacitive coupling between the adjacent dipole antenna elements. In this embodiment, the spaced apart end portions 46' in adjacent legs 44' comprise enlarged width end portions 51' connected to an end of the elongated body portion 49' to provide the increased capacitance coupling between the adjacent dipole antenna elements. Here, for example, the distance K between the spaced apart end portions 46' is about 0.003 inches. Of course, other arrangements which increase the capacitive coupling between the adjacent dipole antenna elements are also contemplated by the present invention.

Figure 4C:
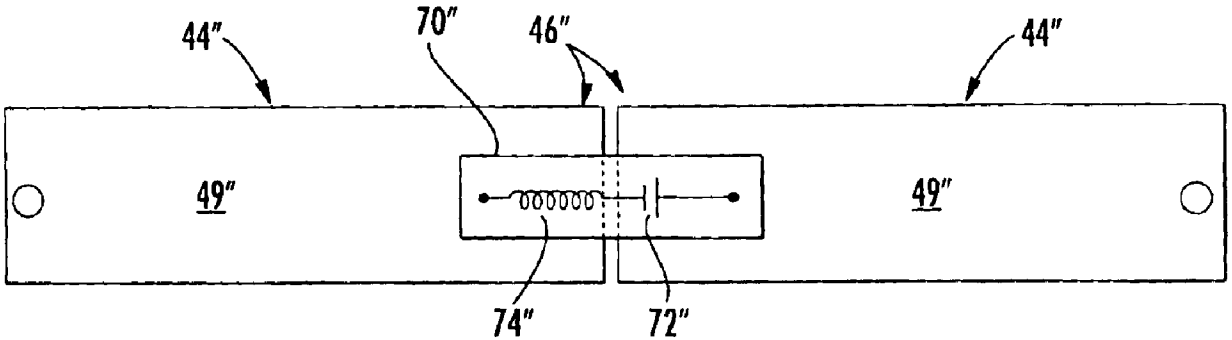

By way of example, to further increase the capacitive coupling between adjacent dipole antenna elements 40, a respective discrete or bulk impedance element may be electrically connected across the spaced apart end portions of adjacent legs 44" of adjacent dipole antenna elements, as illustrated in FIG. 4C. In the illustrated embodiment, the spaced apart end portions 46" have the same width as the elongated body portions connected to an end of the elongated body portions 49".

The discrete impedance elements 70" are preferably soldered in place after the dipole antenna elements 40 have been formed so that they overlay the respective adjacent legs 44" of adjacent dipole antenna elements 40. This advantageously allows the same capacitance to be provided in a smaller area, which helps to lower the operating frequency of the phased array antenna 10.

The illustrated discrete impedance element includes a capacitor 72" and an inductor 74" connected together in series. However, other configurations of the capacitor 72" and inductor 74" are possible, as will be readily appreciated by those skilled in the art. For example, the capacitor 72" and an inductor 74" may be connected together in parallel, or the discrete impedance element 70" may include the capacitor without the inductor or the inductor without the capacitor. Depending on the intended application, the discrete impedance element 70" may even include a resistor.

The discrete impedance element 70" may also be connected between the adjacent legs 44 with the overlapping or interdigitated portions 47 illustrated in FIG. 4A. In this configuration, the discrete impedance element 70" advantageously provides a lower cross polarization in the antenna patterns by eliminating asymmetric currents which flow in the interdigitated capacitor portions 47. Likewise, the discrete impedance element 70" may also be connected between the adjacent legs 44" with the enlarged width end portions 51' illustrated in FIG. 4B.

Another advantage of the respective discrete impedance elements 70" is that they may have impedance values so that the bandwidth of the phased array antenna 10 can be tuned for different applications, as would be readily appreciated by those skilled in the art. In addition, the impedance is not dependent on the impedance properties of the adjacent dielectric layers 24 and adhesives 22. Since the discrete impedance elements 70' are not effected by the dielectric layers 24, this approach advantageously allows the impedance between the dielectric layers 24 and the impedance of the discrete impedance element 70" to be decoupled from one another.

Figure 4D:
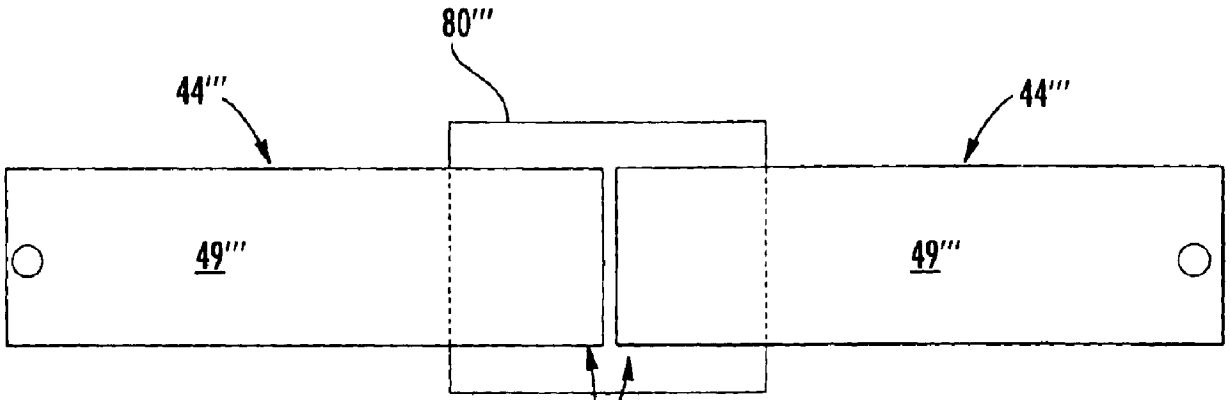

Yet another approach to further increase the capacitive coupling between adjacent dipole antenna elements 40 includes placing a respective printed impedance element 80'" adjacent the spaced apart end portions of adjacent legs 44'" of adjacent dipole antenna elements 40, as illustrated in FIG. 4D. The respective printed impedance elements are separated from the adjacent legs 44'" by a dielectric layer, and are preferably formed before the dipole antenna layer 20 is formed so that they underlie adjacent legs 44'" of the adjacent dipole antenna elements 40.

Alternately, the respective printed impedance elements 80'" may be formed after the dipole antenna layer 20 has been formed. For a more detailed explanation of the printed impedance elements and antenna element configurations, reference is directed to U.S. patent application Ser. No. 10/308,424, which is assigned to the current Assignee of the present invention and is hereby incorporated herein in its entirety by reference, as well as to the above-noted U.S. patent application Ser. No. 10/634,036.

Preferably, the array of dipole antenna elements 40 are arranged at a density in a range of about 100 to 900 per square foot. The array of dipole antenna elements 40 are sized and relatively positioned so that the phased array antenna 10 is operable over frequency range of about 2 to 30 GHz, and at a scan angle of about ±60 degrees (low scan loss). Such an antenna 10 may also have a 10:1 or greater bandwidth, includes conformal surface mounting, while being relatively lightweight, and easy to manufacture at a low cost.

For example, FIG. 4A is a greatly enlarged view showing adjacent legs 44 of adjacent dipole antenna elements 40 having respective spaced apart end portions 46 to provide the increased capacitive coupling between the adjacent dipole antenna elements. In the example, the adjacent legs 44 and respective spaced apart end portions 46 may have the following dimensions: the length E of the enlarged width end portion 51 equals 0.061 inches; the width F of the elongated body portions 49 equals 0.034 inches; the combined width G of adjacent enlarged width end portions 51 equals 0.044 inches; the combined length H of the adjacent legs 44 equals 0.276 inches; the width I of each of the plurality of fingers 53 equals 0.005 inches; and the spacing J between adjacent fingers 53 equals 0.003 inches.

In the example (referring to FIG. 3), the dipole layer 20 may have the following dimensions: a width A of twelve inches and a height B of eighteen inches. In this example, the number C of dipole antenna elements 40 along the width A equals 43, and the number D of dipole antenna elements along the length B equals 65, resulting in an array of 2795 dipole antenna elements. The wideband phased array antenna 10 has a desired frequency range, e.g., 2 GHz to 18 GHz, and the spacing between the end portions 46 of adjacent legs 44 is less than about one-half a wavelength of a highest desired frequency.

Figure 5:
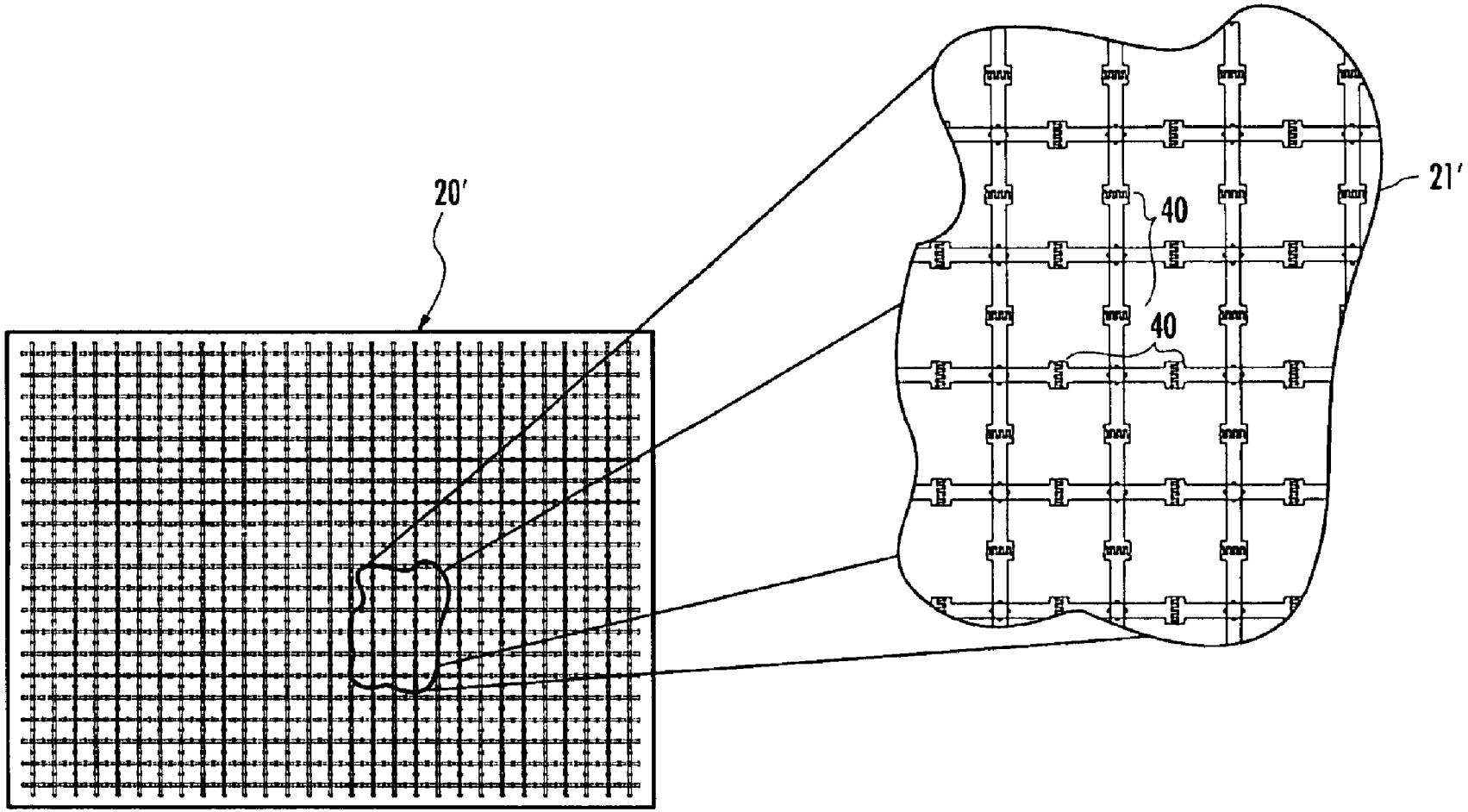
FIG. 5 a schematic diagram of the printed conductive layer of another embodiment of the wideband phased array antenna of FIG. 2.

Referring to FIG. 5, another embodiment of the dipole layer 20' may include first and second sets of dipole antenna elements 40 which are orthogonal to each other to provide dual polarization, as will be appreciated by the skilled artisan. The phased array antenna 10 may be made by forming the array of dipole antenna elements 40 on the flexible substrate 23. This preferably includes printing and/or etching a conductive layer of dipole antenna elements 40 on the substrate 23. As shown in FIG. 5, first and second sets of dipole antenna elements 40 may be formed orthogonal to each other to provide dual polarization.

Again, each dipole antenna element 40 includes the medial feed portion 42 and the pair of legs 44 extending outwardly therefrom. Forming the array of dipole antenna elements 40 includes shaping and positioning respective spaced apart end portions 46 of adjacent legs 44 of adjacent dipole antenna elements to provide increased capacitive coupling between the adjacent dipole antenna elements. Shaping and positioning the respective spaced apart end portions 46 may include forming interdigitated portions 47 (FIG. 4A) or enlarged width end portions 51' (FIG. 4B), etc. A ground plane 30 is preferably formed adjacent the array of dipole antenna elements 40, and one or more dielectric layers 24, 26 are layered on both sides of the dipole layer 20 with adhesive layers 22 therebetween.

Forming the array of dipole antenna elements 40 may further include forming each leg 44 with an elongated body portion 49, an enlarged width end portion 51 connected to an end of the elongated body portion, and a plurality of fingers 53 extending outwardly from the enlarged width end portion. Again, the wideband phased array antenna 10 has a desired frequency range, and the spacing between the end portions 46 of adjacent legs 44 is less than about one-half a wavelength of a highest desired frequency. The ground plane 30 is spaced from the array of dipole antenna elements 40 less than about one-half a wavelength of the highest desired frequency.

As discussed above, the array of dipole antenna elements 40 are preferably sized and relatively positioned so that the wideband phased array antenna 10 is operable over a frequency range of about 2 GHz to 30 GHz, and operable over a scan angle of about ±60 degrees. The antenna 10 may also be mounted on a rigid mounting member 12 having a non-planar three-dimensional shape, such as an aircraft, for example.

Thus, a phased array antenna 10 with a wide frequency bandwidth and a wide scan angle is obtained by utilizing tightly packed dipole antenna elements 40 with large mutual capacitive coupling. Conventional approaches have sought to reduce mutual coupling between dipoles, but the present invention makes use of, and increases, mutual coupling between the closely spaced dipole antenna elements to prevent grating lobes and achieve the wide bandwidth. The antenna 10 is scannable with a beam former, and each antenna dipole element 40 has a wide beam width. The layout of the elements 40 could be adjusted on the flexible substrate 23 or printed circuit board, or the beam former may be used to adjust the path lengths of the elements to put them in phase.

Figure 6:
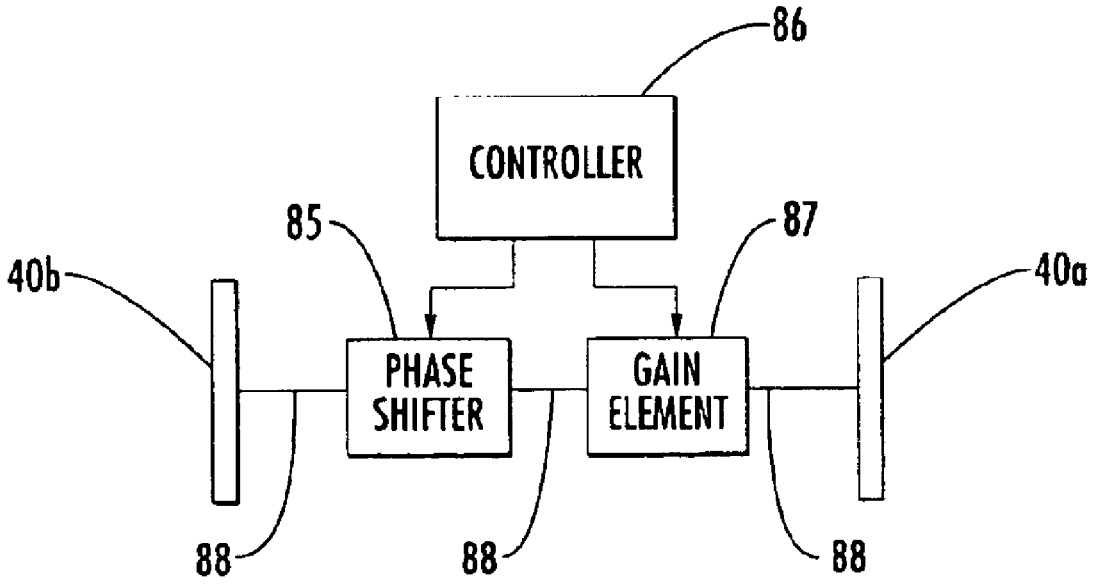
FIG. 6 is a schematic block diagram illustrating the redirecting feedthrough lens antenna of FIG. 1 in greater detail.

Turning additionally to FIG. 6, the redirecting feedthrough lens antenna system 60 will now be further described. As noted above, the system 60 includes the first and second phased array antennas 10*a*, 10*b* coupled together in back-to-back relation, each of which includes an array of antenna elements 40 thereon. The system 60 also illustratively includes a respective phase shifter 85 connected between each pair of back-to-back dipole antenna elements 40*a*, 40*b* of the first and second dipole antenna arrays, although only a single pair of antenna elements and the respective phase shifter 85 therefor is shown for clarity of illustration.

Furthermore, a controller 86 cooperates with the phase shifters 85 to cause a signal received by the first phased array antenna 10*a* at the first angle $\theta_1$ to be transmitted from the second phased array antenna 10*b* at a redirected second angle $\theta_2$ different from the first angle, as will be appreciated by those skilled in the art. It will also be appreciated by those skilled in the art that the various phase control operations performed by the controller 85 may in some embodiments be spread across multiple controllers arranged in a hierarchy. This approach may be particularly advantageous for larger antenna arrays, for example.

The redirecting feedthrough lens antenna system 60 may further include a respective gain element 87 also connected between each pair of back-to-back dipole antenna elements 40*a*, 40*b* of the first and second dipole antenna arrays, and the controller 86 may similarly control a gain of the gain elements. Moreover, the phase shifters 85 and gain elements 87 between each pair of back-to-back dipole antenna arrays 40*a*, 40*b* may be connected in series, as shown. In particular, the antenna elements 40*a*, 40*b*, phase shifter 85, and gain element 87 may be connected by transmission elements 88, which may be coaxial cables, for example. Of course, other suitable feed structures known to those of skill in the art may also be used as well.

Additionally, the phase shifters 85 and gain elements 87 may be positioned between (or within) the ground planes 30*a*, 30*b* of the first and second phased array antennas 10*a*, 10*b*. Further details regarding suitable coupling structures for connecting the first and second phased array antennas 10*a*, 10*b* in a back-to-back relationship may be found in the above-noted U.S. Pat. No. 6,417,813.

It should also be noted that there can be different geometrical arrangements of dipole elements 40 that can provide for the transmission or rejection of polarized waves. The system 60 may be configured with an arrangement of dipole elements 40 oriented in one direction, providing a single linear polarization (the terms "vertical" or "horizontal" are often used but a single linear polarization may have any orientation relative to a given reference angle) or may include crossed dipoles which would provide for a more general antenna solution. Crossed dipoles, nominally oriented at ninety degrees to one another (see FIG. 5), provide two basis vectors from which any sense linear or elliptical polarization may be formed with appropriate phasing of the elements, as will be appreciated by those skilled in the art. Of course, other geometrical or element arrangements for polarization control may also be used, as will also be appreciated by those skilled in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A redirecting feedthrough lens antenna system comprising:

first and second phased array antennas coupled together in back-to-back relation and comprising respective first and second arrays of dipole antenna elements thereon, each dipole antenna element comprising a medial feed portion and a pair of legs extending outwardly therefrom;

a respective phase shifter connected between each pair of back-to-back dipole antenna elements of said first and second dipole antenna arrays; and a controller for cooperating with said phase shifters to cause a signal received by said first phased array antenna at a first angle to be transmitted from said second phased array antenna at a second redirected angle different from the first angle.

2. The redirecting feedthrough lens antenna system of claim 1 further comprising a respective gain element also connected between each pair of back-to-back dipole antenna elements of said first and second dipole antenna arrays.

3. The redirecting feedthrough lens antenna system of claim 2 wherein said controller also controls a gain of said gain elements.

4. The redirecting feedthrough lens antenna system of claim 2 wherein said phase shifters and gain elements connected between each pair of back-to-back dipole antenna elements of said first and second dipole antenna arrays are connected in series.

5. The redirecting feedthrough lens antenna system of claim 1 wherein adjacent legs of adjacent dipole antenna elements include respective spaced apart end portions.

6. The redirecting feedthrough lens antenna system of claim 5 wherein the spaced apart end portions have predetermined shapes and relative positioning to provide increased capacitive coupling between the adjacent dipole antenna elements.

7. The redirecting feedthrough lens antenna system of claim 5 further comprising a respective impedance element electrically connected between the spaced apart end portions of adjacent legs of adjacent dipole antenna elements.

8. The redirecting feedthrough lens antenna system of claim 7 wherein said impedance elements comprise capacitors.

9. The redirecting feedthrough lens antenna system of claim 7 wherein said impedance elements comprise inductors.

10. The redirecting feedthrough lens antenna system of claim 1 further comprising a ground plane adjacent said first and second dipole element arrays.

11. A redirecting feedthrough lens antenna system comprising:

first and second phased array antennas coupled together in back-to-back relation and comprising respective first and second arrays of dipole antenna elements thereon, each dipole antenna element comprising a medial feed portion and a pair of legs extending outwardly therefrom;

a ground plane adjacent said first and second dipole element arrays;

a respective phase shifter and a respective gain element connected between each pair of back-to-back dipole antenna elements of said first and second dipole antenna arrays; and a controller for cooperating with said phase shifters to cause a signal received by said first phased array antenna at a first angle to be transmitted from said second phased array antenna at a redirected second angle different from the first angle, and said controller also controlling a gain of said gain elements.

12. The redirecting feedthrough lens antenna system of claim 11 wherein said phase shifters and gain elements connected between each pair of back-to-back dipole antenna elements of said first and second dipole antenna arrays are connected in series.

13. The redirecting feedthrough lens antenna system of claim 11 wherein adjacent legs of adjacent dipole antenna elements include respective spaced apart end portions.

14. The redirecting feedthrough lens antenna system of claim 13 wherein the spaced apart end portions have predetermined shapes and relative positioning to provide increased capacitive coupling between the adjacent dipole antenna elements.

15. The redirecting feedthrough lens antenna system of claim 13 further comprising a respective impedance element electrically connected between the spaced apart end portions of adjacent legs of adjacent dipole antenna elements.

16. The redirecting feedthrough lens antenna system of claim 15 wherein said impedance elements comprise capacitors.

17. The redirecting feedthrough lens antenna system of claim 15 wherein said impedance elements comprise inductors.

18. A method of using a redirecting feedthrough lens antenna system comprising first and second phased array antennas coupled together in back-to-back relation and comprising respective first and second arrays of dipole antenna elements thereon, each dipole antenna element comprising a medial feed portion and a pair of legs extending outwardly therefrom, and further comprising a respective phase shifter connected between each pair of back-to-back dipole antenna elements of the first and second dipole antenna arrays, the method comprising:

controlling the phase shifters to cause a signal received by the first phased array antenna at a first angle to be transmitted from the second phased array antenna at a redirected second angle different from the first angle.

19. The method of claim 18 wherein the redirecting feedthrough lens antenna system further comprises a respective gain element also connected between each pair of back-to-back dipole antenna elements of the first and second dipole antenna arrays; and further comprising controlling a gain of the gain elements.

* * * * *